US007789586B2

(12) United States Patent
Ess

(10) Patent No.: US 7,789,586 B2
(45) Date of Patent: Sep. 7, 2010

(54) ANGLED MANHOLE SEALING BAND AND METHOD FOR USE

(75) Inventor: Paul H Ess, Plymouth, MN (US)

(73) Assignee: SSI Partnership, LLC, Loretto, MN (US)

( * ) Notice: Subject to any disclaimer, the term of this patent is extended or adjusted under 35 U.S.C. 154(b) by 29 days.

(21) Appl. No.: 12/234,175

(22) Filed: Sep. 19, 2008

(65) Prior Publication Data

US 2009/0074509 A1 Mar. 19, 2009

Related U.S. Application Data

(63) Continuation of application No. 11/654,369, filed on Jan. 17, 2007, now abandoned.

(51) Int. Cl.
*E02D 29/14* (2006.01)

(52) U.S. Cl. ..... 404/25; 52/19

(58) Field of Classification Search ..... 404/25, 404/26; 52/19, 20

See application file for complete search history.

(56) References Cited

U.S. PATENT DOCUMENTS

| | | | | |
|---|---|---|---|---|
| 1,374,852 | A | | 4/1921 | Ingram |
| 3,958,313 | A | | 5/1976 | Rossborough |
| 4,103,901 | A | | 8/1978 | Ditcher |
| 4,305,679 | A | | 12/1981 | Modi |
| 4,325,572 | A | | 4/1982 | Arntyr et al. |
| 4,387,900 | A | | 6/1983 | Ditcher et al. |
| 4,469,467 | A | | 9/1984 | Odill et al. |
| 4,475,845 | A | | 10/1984 | Odill et al. |
| 4,557,625 | A | | 12/1985 | Jahnke et al. |
| 4,711,455 | A | | 12/1987 | Ditcher et al. |
| 4,737,220 | A | | 4/1988 | Ditcher et al. |
| 4,746,127 | A | | 5/1988 | Westhoff et al. |
| 4,759,656 | A | * | 7/1988 | Wilson ..... 404/26 |
| 4,793,387 | A | | 12/1988 | LeBlanc et al. |
| 4,890,863 | A | | 1/1990 | Westhoff et al. |
| 4,903,970 | A | | 2/1990 | Ditcher et al. |
| 4,955,641 | A | | 9/1990 | Dent |
| 5,021,261 | A | | 6/1991 | Bowman |
| 5,032,197 | A | | 7/1991 | Trimble |
| 5,046,886 | A | | 9/1991 | Muir et al. |
| 5,388,868 | A | | 2/1995 | Burkit |
| 5,398,979 | A | | 3/1995 | Longpré et al. |
| 5,431,553 | A | | 7/1995 | Topf, Jr. |
| 5,496,128 | A | | 3/1996 | Odill |
| 5,511,897 | A | | 4/1996 | House et al. |
| 5,531,485 | A | | 7/1996 | House et al. |
| 5,613,806 | A | | 3/1997 | House et al. |
| 5,800,648 | A | | 9/1998 | House et al. |

(Continued)

OTHER PUBLICATIONS

Sealing Systems, Inc., Infi-Shield® Uniband Installation Procedures; pp. 1-2; Undated.

(Continued)

*Primary Examiner*—Raymond W Addie
(74) *Attorney, Agent, or Firm*—Patterson Thuente Christensen Pederson, PA

(57) ABSTRACT

The invention relates to a device and method for sealing a manhole structure. A band with a relatively rigid angled corner engages the upper margin of a manhole structure. Adhesives may also be used with the band to enhance the seal with the manhole structure.

21 Claims, 4 Drawing Sheets

U.S. PATENT DOCUMENTS

| | | | |
|---|---|---|---|
| 5,876,039 | A | 3/1999 | Skinner et al. |
| 5,876,533 | A | 3/1999 | House et al. |
| 6,044,590 | A | 4/2000 | Gagas |
| 7,150,580 | B1 | 12/2006 | Ess |
| 2003/0129027 | A1 | 7/2003 | Navarrete |
| 2004/0080930 | A1 | 4/2004 | Winters et al. |
| 2004/0124591 | A1 | 7/2004 | Sekulich et al. |
| 2008/0170908 | A1 | 7/2008 | Ess |

OTHER PUBLICATIONS

NeeNah Foundry Co., Product Catalog; pp. 32-33; Mar. 22, 2005.
Tech Data, Cretex Specialty Products; *External Manhole Chimney Seal;* pp. 1-4; Dated Sep. 1998.
SurSeal, Mar Mac; *An External Manhole Frame/Chimney Seal;* pp. 1-2, Undated.
Adaptor Inc.; *Internal/External Adaptor Seal;* pp. 1-4, Undated.
Adaptor Inc.; *Internal/External Adaptor Seal Specification;* 1 Page; Undated.

* cited by examiner

ANGLED MANHOLE SEALING BAND AND METHOD FOR USE

RELATED APPLICATIONS

This application is a continuation of U.S. patent application Ser. No. 11/654,369, filed Jan. 17, 2007, now abandoned, published as U.S. Patent Application Publication No. 2008/0170908, and hereby incorporated herein by reference in its entirety.

FIELD OF THE INVENTION

This invention relates to manhole structures. In particular, it relates to a method and device for sealing a manhole structure.

BACKGROUND OF THE INVENTION

Manholes are used to provide street-level access to sewer lines and other underground structures. Most often, the top portion of the manhole has the form of a cylindrical frame (or casting) with a lid. The lower portion of the casting, which is not generally seen after installation, often resembles a hat with a brim. This hat-shaped casting rests on a concrete cone leading to a sewer line. The upper portion of the casting defines an opening that may be closed with a lid. The elevation of the manhole casting and lid may be raised to the level of the surrounding surface grade by placing one or more concrete adjusting rings between the bottom of the casting and the cone. A manhole structure is thus created by stacking a number of components on top of each other. After the manhole structure is installed, the space around it is typically filled in with earth so that the lid at the top portion of the manhole casting is conveniently accessible at street-level.

Manholes created by such stacking of components are vulnerable to leaks. Water and other contaminants may enter through gaps between the stacked components after installation. Once the manhole structure has been installed and earth has been filled in around it, gaps below the ground level become difficult to reach. It is thus desirable to seal the manhole structure during installation to prevent future leaks at the interfaces between the stacked components.

Various methods and devices are known for sealing the external surfaces of manhole structures. One method employs an elastomeric band positioned around the top portion of the cone and extending over the adjusting rings to the base of the manhole casting. Because the cone and the adjusting rings have generally the same outer perimeter, one or more sealing bands may be used to provide an external seal for the gaps between these components. A band extends over the cone (and any adjusting rings) to the casting base as in U.S. Pat. No. 5,876,533 or may extend in tapered form to the upper portion of the casting as in U.S. Pat. No. 7,150,580.

To reduce the risk of accumulating water or contaminants between the inner layer of the seal and the outer layer of the manhole, methods have been devised for keeping the external seal snugly fitted to the manhole structure. A heat-sealing method, for example, is known whereby the sealing band is heated before fitting so that it may be secured tightly to the manhole structure, thereby reducing bulges and air pockets. But methods that use heat require a heat source, often torches and other special tools that involve hazards to the user.

What is needed in the industry is a device and method for sealing a manhole structure so that the seal is retained in close proximity to the external surfaces of manhole structure without the use of heat-sealing methods.

SUMMARY OF THE INVENTION

The problems described above are solved in substantial part by a band for sealing a manhole structure that has an L-shaped corner with that is more rigid than the rest of the band. The band includes first and second portions extending from the L-shaped corner at a generally 90-degree angle to each other. The L-shaped corner may extend equal or unequal distances in the direction of the first and second portions. The band may be integrally molded or formed by from separate pieces of material.

The rigidity of the L-shaped corner may be enhanced by making it from a thicker material than the first or second portions. The thickness of the L-shaped corner may be at least twice the thickness of the first and second portions.

A method for using a band with an L-shaped corner includes rolling the band over the exterior of the casting and the upper margin of a manhole structure and fitting the L-shaped corner to the upper margin defining a corner such that the first portion extends toward the casting and the second portion covers at least part of the upper margin. The L-shaped corner may be fitted to either a corner defined by the upper margin of a cone (when no adjusting rings are used) or to a corner defined by the uppermost adjusting ring. An adhesive may be applied to the band's inner surface to enhance the seal formed against the manhole structure. A butyl mastic adhesive may be used, either alone or in conjunction with a primer applied to the surfaces of the manhole structure that will contact the adhesive.

DETAILED DESCRIPTION

As shown in FIGS. 1-5, sealing band 10 is generally L-shaped, with a first portion 12 that extends horizontally in relation to a manhole structure, a second portion 14 that extends vertically, and a corner 34 linking the first and second portions.

Figure 1:
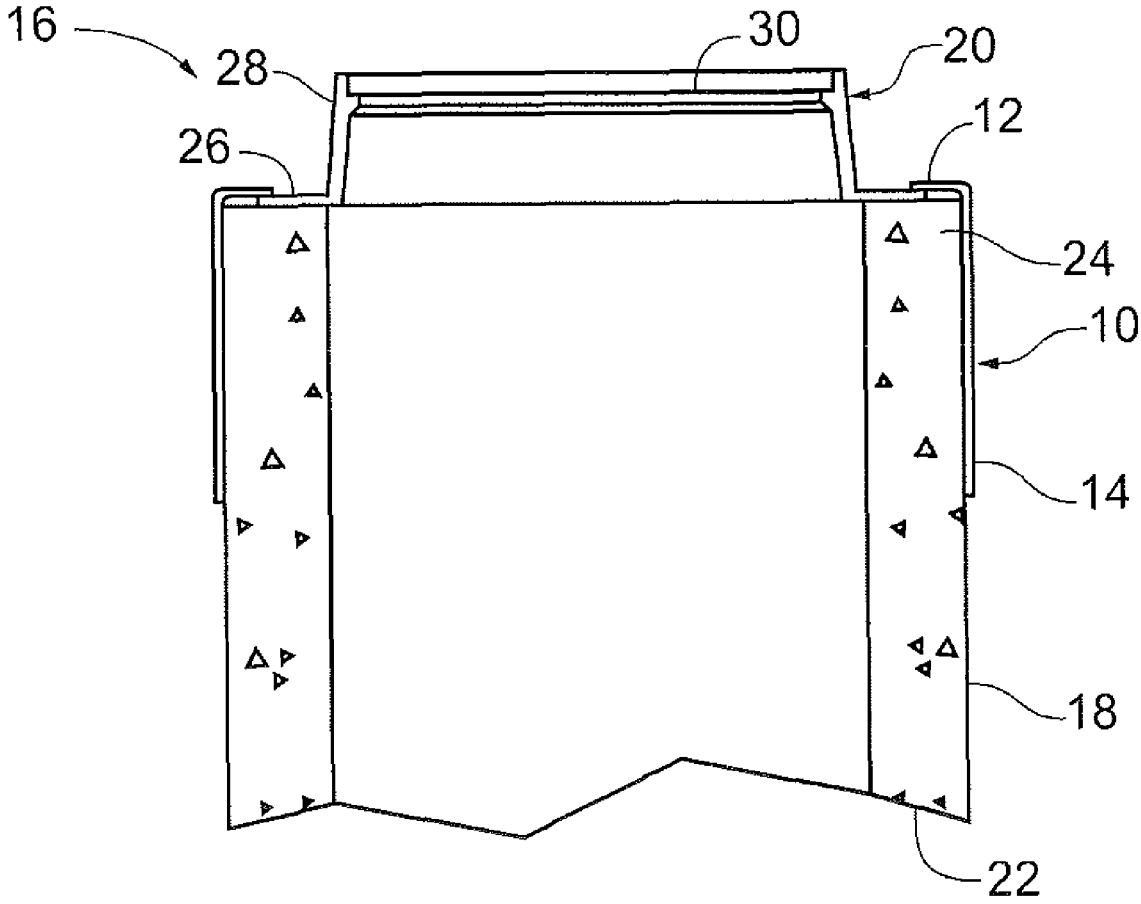
FIG. 1 is cut-away plan view of an embodiment of the invention in place around a manhole structure.

In FIG. 1, band 10 is shown in position around a cross section of manhole structure 16. Manhole structure 16 includes a cone 18 and a casting 20. Cone 18 has a lower portion 22 that extends downward to a sewer (not shown) and an upper margin 24 on which casting 20 is disposed. The casting 20 is generally hat shaped and includes a brim portion 26, an upper portion 28, and a lid-receiving portion 30.

Band 10 is positioned around the exterior periphery of the upper margin 24 of cone 18 and overlaps with part of brim portion 26 of casting 20. In the embodiment shown in FIG. 1, cone 18 is shown without adjusting rings.

Figure 2:
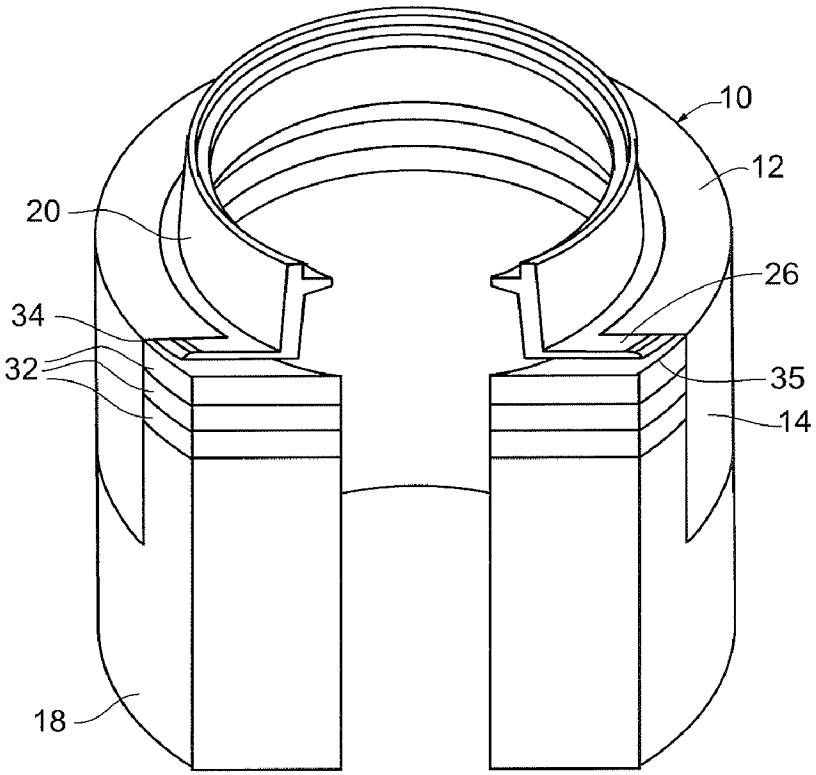
FIG. 2 is a cross-section view of an embodiment of the invention in place around a manhole structure.

The positioning of band 10 around manhole structure 16 is shown in greater detail in FIG. 2, which shows a cut-away view of manhole structure 16. In FIG. 2, manhole structure 16 includes cone 18 and casting 20 as in FIG. 1, but also includes adjusting rings 32. As shown in FIG. 2, band 10 extends around the periphery of cone 18 and adjusting rings 32. When adjusting rings 32 are stacked on cone 18, one or more adjusting ring, 32 may be used. In such embodiments, corner 34 of band 10 corresponds to a corner 35 defined by the uppermost adjusting ring 32.

Figure 3:
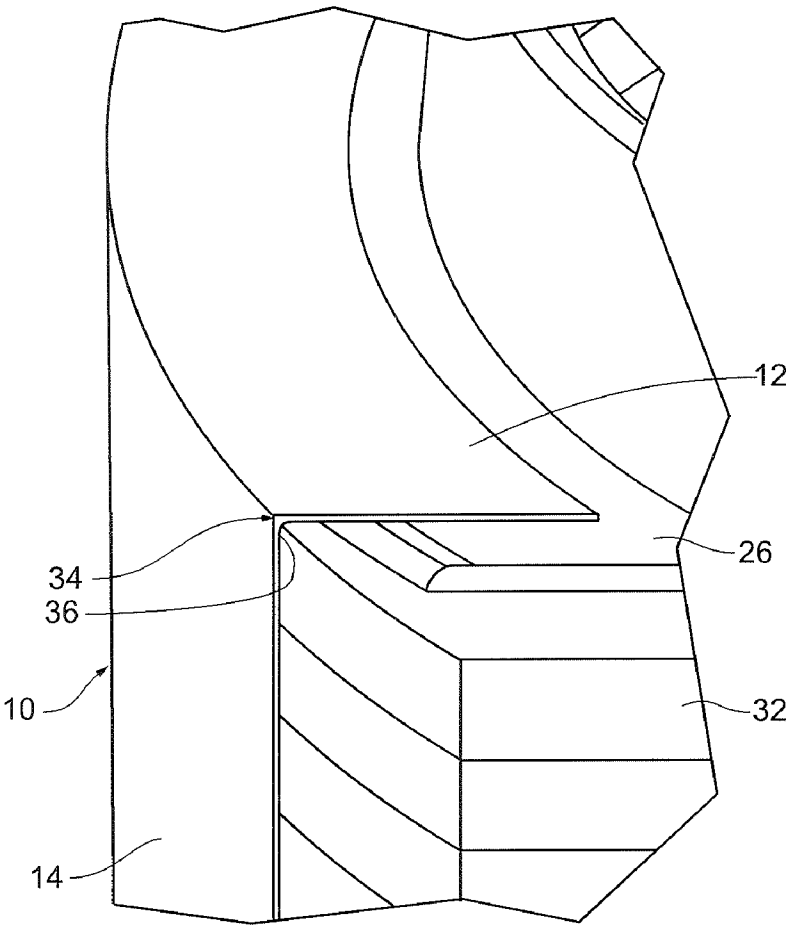
FIG. 3 is a detailed cross-sectional view showing an embodiment of the invention in place around the upper margin of a manhole structure.

In an embodiment, the material used to form corner 34 of band 10 is thicker than the material that forms first and second portions 12, 14. As shown in FIG. 3, which provides a detail of the cross-sectional view of band 10, the inner side 36 of corner 34 is reinforced with more material than the other portions of band 10.

Figure 4A:
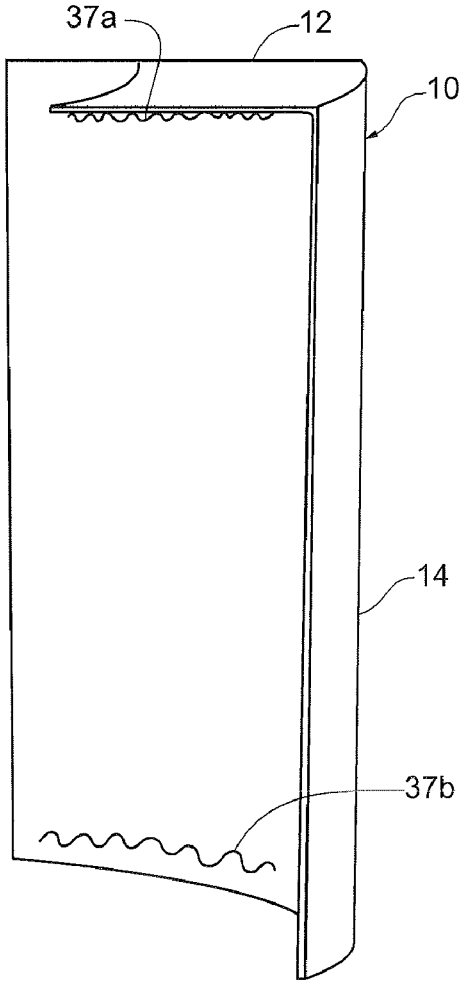
FIG. 4A is a cross-sectional view of the embodiment of the band of the invention.

As shown in FIG. 4A, first and second portions 12, 14 of band 10 may be unequal in length. Referring back to FIGS. 1 and 2, it can be seen that first portion 12 extends from corner 34 to cover the interface between the uppermost adjusting ring 32 (or upper margin 24 of cone 18) and the brim portion 26 of casting 20. Second portion 14 extends beyond the height of the stacked adjusting rings 32. First and second portions 12, 14 may also extend the same distance from corner 34.

For example, where cone 18 in FIG. 1 is 39¼" in diameter and casting 20 is 29" in diameter, there are 5⅛" of material from corner 32 to the end of first portion 12 and 16" of material from corner 34 to the end of second portion 14. In this embodiment, band 10 has an outer circumference of 123¼" and an inner circumference of 91".

Figure 4B:
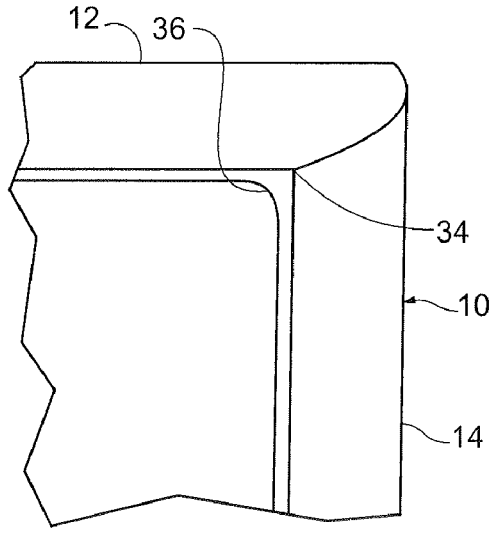
FIG. 4B is a detailed cross-sectional view of an embodiment of the corner of the band of the invention.
Figure 4C:
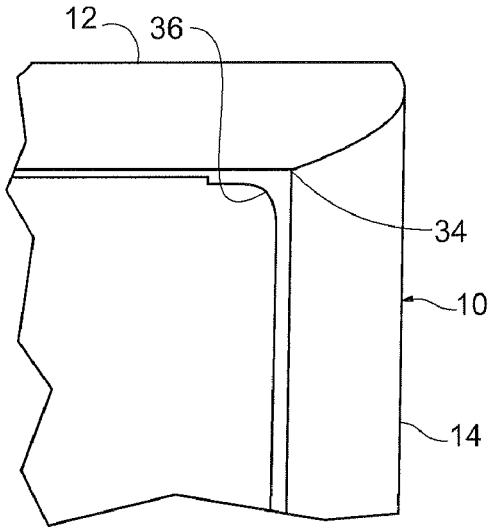
FIGS. 4C and 4D show alternative embodiments of the invention depicted in FIG. 4B.
Figure 4D:
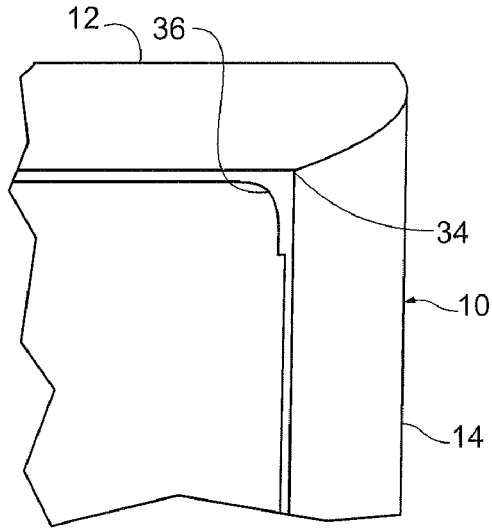

In the embodiment shown in FIG. 4B, corner 34 is thicker than the rest of band 10, which is shown in FIG. 4B by the curvature of the inner side 36 of corner 34. In this embodiment, corner 34 is made from the same material as first and second portions 12, 14. Corner 34 may extend equally in both directions. In the embodiment shown in FIG. 1, corner 34 extends 1" toward each of the first and second portions 12, 14. In other embodiments, corner 34 may extend unequally.

Corner 34 may be formed integrally, for example, by molding. Or first and second portions 12, 14 may be attached to corner 34. In a preferred embodiment, first and second portions 12, 14 are made of a resilient material that can be rolled over a manhole structure and has sufficient thickness to withstand the environmental conditions generally found at manhole-construction sites. For example, band 10 may be constructed from ethylene propylene diene monomer (EPDM) rubber. The thickness of the first and second portions is approximately 65 mili-inches (mils). The thickness of the preformed corner portion is approximately twice that, or 130 mils.

Alternatively, a more rigid material may be used to form corner 34 than is used for the rest of band 10. In this alternative embodiment, the thickness of corner 34 may not be different than the thickness of the rest of band 10, and may even be less, depending on the material used.

Figure 5:
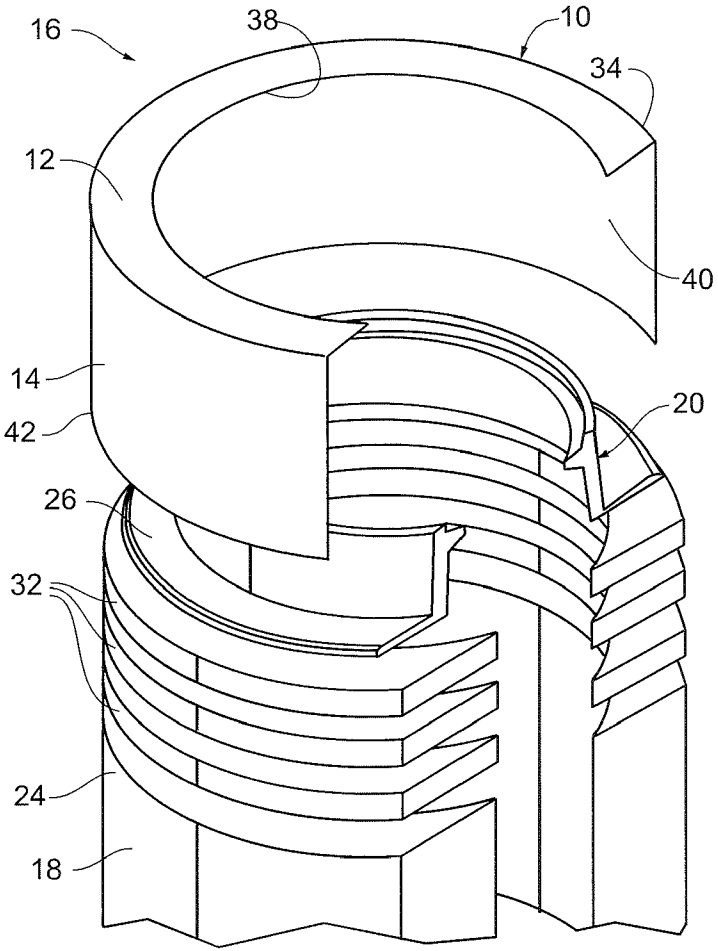
FIG. 5 is an exploded cross-sectional view of a manhole structure and an embodiment of the invention.

In use, band 10 is preformed in generally the shape shown in FIG. 5 and brought to a site where a manhole structure is being installed. As shown in FIG. 1, manhole structure 16 may be created by placing casting 20 directly on cone 18. Frequently, however, the elevation of cone 18 alone is insufficient to reach the desired surface grade. Thus, one or more adjusting rings 32 are added to the top of cone 18, as best shown in FIG. 5. Band 10 is positioned so that corner 34 is fitted to the topmost adjusting ring 32, if adjusting rings 32 are used, or to the upper margin 24 of cone 18, if no adjusting rings 32 are used. In this position, first portion 12 extends to cover brim portion 26 of casting 20 while second portion 14 extends to cover either the upper margin of cone 24 (if no adjusting rings 32 are used, or adjusting rings 32.

Figure 6:
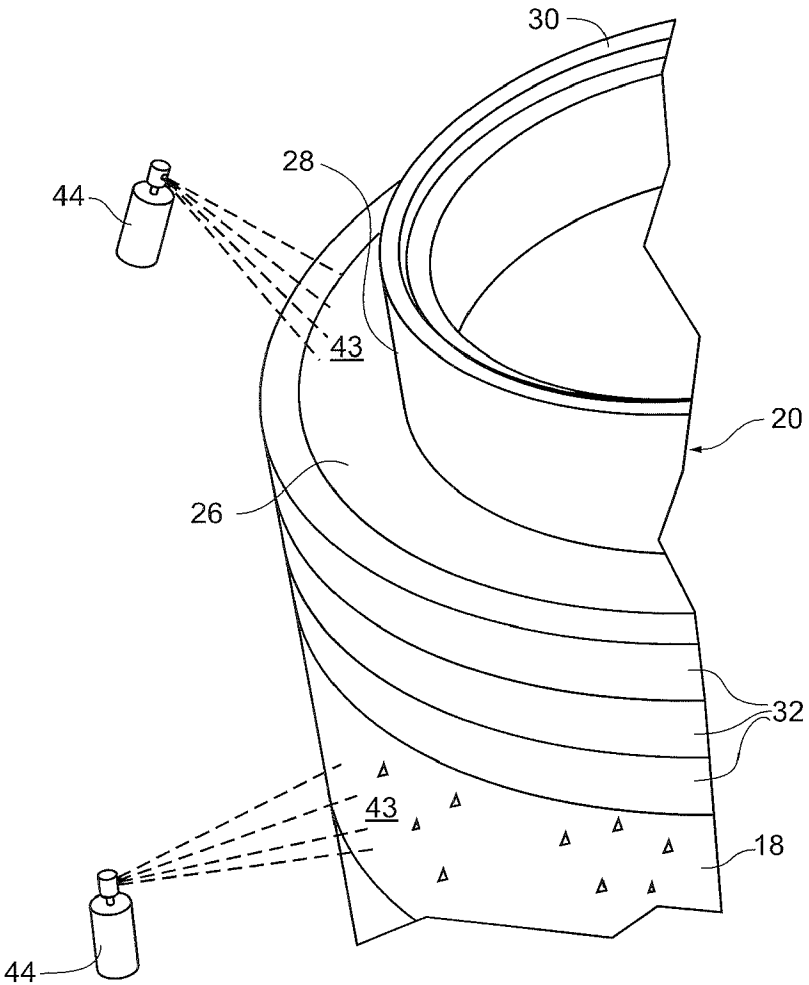
FIG. 6 is a cross-sectional view of a manhole structure.

In an alternative embodiment, as shown in FIG. 6, an adhesive 37*a*, 37*b* is applied around either the inner side 38 of first portion 12 or the inner side 40 of second portion 14, or both. For example, as shown in FIG. 4A, butyl mastic 37*a* may be applied all the way around the underside of first portion 12. The adhesive may be applied in different proportions, for example, where the first portion 12 is 5⅛", the adhesive 37*a* may be applied as a strip 5" wide. This arrangement will enhance the seal created by first portion 12 against uppermost adjusting ring 32 and brim portion 26 of casting 20. Near the bottom edge 42 of second portion 14, a 2" wide strip of adhesive 37*b* may be used to provide an enhanced seal around lower portion 22 of cone 18. Strips of other sizes may also be used to seal first portion 12 or second portion 14 to manhole structure 16. A primer 43 may also be applied to the external surfaces of manhole structure 16 to enhance the seal formed by the adhesive. For example, when a butyl mastic adhesive is placed on first or second portions 12, 14, a primer-delivery device 44 may be used to apply primer 43 in aerosol form to the corresponding portions of the manhole structure.

The invention claimed is:

1. A manhole comprising:

a cone presenting a substantially planar cone surface and a curved cone surface, the substantially planar cone surface and the curved cone surface defining an outer cone corner;

a casting having a raised portion coupled to a brim portion, the brim portion coupleable to the substantially planar cone surface;

a sealing band having a substantially planar sealing band portion coupled to a curved sealing band portion at a juncture, the substantially planar sealing band portion and the curved sealing band portion increasing in thickness at the juncture, the juncture presenting an inner sealing band corner and an outer sealing band corner which form a reinforced sealing band corner;

an adhesive disposing the substantially planar sealing band portion to the brim portion of the casting and the curved sealing band portion to the curved cone surface.

2. The manhole of claim 1, wherein a first non juncture portion of the substantially planar sealing band portion and a second non juncture portion of the second curved sealing band portion have substantially uniform thicknesses.

3. The manhole of claim 1, wherein the curved sealing band portion and the first substantially planar sealing band portion have substantially similar thicknesses.

4. The manhole of claim 1, wherein the substantially planar sealing band portion and the curved sealing band portion are integrally molded.

5. The manhole of claim 1, further comprising at least one adjusting ring positioned on the substantially planar cone surface and having an outer ring corner, the sealing band being positionable about the outer ring corner of the adjusting ring.

6. The manhole of claim 5, wherein the adjusting ring and the cone create an interface, the second curved portion of the sealing band being further adapted to cover the interface.

7. The manhole of claim 1, wherein the adhesive is butyl mastic.

8. The manhole of claim 1, wherein the inner sealing band corner is positionable about the outer cone corner such that the substantially planar sealing band portion is at least partially coextensive with the brim portion of the casting and the curved sealing band portion is substantially coextensive with the curved cone surface.

9. The manhole of claim 8, wherein the inner sealing band corner defines a substantially rounded surface.

10. The manhole of claim 9, wherein the outer sealing band corner is substantially square.

11. The manhole of claim 1, wherein the sealing band is constructed from ethylene propylene diene monomer rubber.

12. The manhole of claim 9, wherein a radius of curvature of the inner sealing band corner defines a thickness of the juncture.

13. The manhole of claim 1, wherein the juncture is formed from a material more rigid than the planar and curved sealing band portions.

14. A method of sealing a manhole structure, the method comprising the steps of:

providing a sealing band having a substantially planar sealing band portion coupled to a curved sealing band portion at a juncture, the substantially planar sealing band portion and the curved sealing band portion increasing in thickness at the juncture, the juncture presenting an inner sealing band corner and an outer sealing band corner;

providing a cone presenting a substantially planar cone surface and a curved cone surface, the substantially planar cone surface and the curved cone surface defining an outer cone corner which form a reinforced sealing band corner;

providing a casting having a raised portion coupled to a brim portion;

disposing the brim portion of the casting to the substantially planar cone surface;

adhering the sealing band to the brim portion of the casting and the outer cone surface of the cone.

15. The method of claim 14, further comprising applying a primer to the outer cone surface and the brim portion of the casting.

16. The method claim 14, further comprising applying an adhesive to the sealing band.

17. The method of claim 16, wherein applying the adhesive comprises applying butyl mastic.

18. The method of claim 14, further comprising forming the juncture from a first material that is more rigid than the planar and curved sealing band portions.

19. The method of claim 14, further comprising receiving the outer cone corner with the inner sealing band corner.

20. The method of claim 14, further comprising positioning an adjusting ring substantially coextensive with the substantially planar cone surface.

21. The method of claim 20, further comprising substantially sealing an interface between the adjusting ring and the cone with the sealing band.

* * * * *

UNITED STATES PATENT AND TRADEMARK OFFICE

CERTIFICATE OF CORRECTION

PATENT NO. : 7,789,586 B2
APPLICATION NO. : 12/234175
DATED : September 7, 2010
INVENTOR(S) : Paul H. Ess It is certified that error appears in the above-identified patent and that said Letters Patent is hereby corrected as shown below:

Col. 2, line 5, please delete “with”;

Col. 2, line 10, please delete “by”;

Col. 2, line 33, please delete “is cut-away” and insert --is a cut-away--;

Col. 4, line 2, please delete “used,” and insert --used)--.

Col. 4, line 10, please delete “5" wide” and insert --5" wide--;

Col. 4, line 42, please delete “non juncture” and insert --non-juncture--;

Col. 4, line 44, please delete “non juncture” and insert --non-juncture--.

Signed and Sealed this
Twentieth Day of December, 2011

David J. Kappos

David J. Kappos
*Director of the United States Patent and Trademark Office*